US011242638B2

(12) United States Patent
Cho et al.

(10) Patent No.: US 11,242,638 B2
(45) Date of Patent: Feb. 8, 2022

(54) WASHING MACHINE

(71) Applicant: SAMSUNG ELECTRONICS CO., LTD., Suwon-si (KR)

(72) Inventors: Hwang Mook Cho, Suwon-si (KR); Jun Hong Park, Yongin-si (KR); Eung Ryeol Seo, Suwon-si (KR); Geon Ung Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 218 days.

(21) Appl. No.: 16/077,538

(22) PCT Filed: Feb. 6, 2017

(86) PCT No.: PCT/KR2017/001273
§ 371 (c)(1),
(2) Date: Aug. 13, 2018

(87) PCT Pub. No.: WO2017/138723
PCT Pub. Date: Aug. 17, 2017

(65) Prior Publication Data

US 2019/0048505 A1 Feb. 14, 2019

(30) Foreign Application Priority Data

Feb. 12, 2016 (KR) ..... 10-2016-0016297

(51) Int. Cl.
*D06F 37/26* (2006.01)
*D06F 37/12* (2006.01)
(Continued)

(52) U.S. Cl.
CPC ..... *D06F 37/267* (2013.01); *D06F 37/12* (2013.01); *D06F 37/263* (2013.01);
(Continued)

(58) Field of Classification Search
CPC ..... D06F 37/267
See application file for complete search history.

(56) References Cited

U.S. PATENT DOCUMENTS

2010/0064444 A1 3/2010 Nieh et al.
2016/0258103 A1* 9/2016 Hunnell ..... D06F 37/26

FOREIGN PATENT DOCUMENTS

JP 2000-202189 7/2000
KR 2000-0066178 11/2000
(Continued)

OTHER PUBLICATIONS

International Search Report dated Apr. 25, 2017 in corresponding International Patent Application No. PCT/KR2017/001273.
(Continued)

*Primary Examiner* — Jason Y Ko
(74) *Attorney, Agent, or Firm* — Staas & Halsey, LLP

(57) ABSTRACT

Provided is a washing machine having an improved structure for efficiently controlling a distribution of washing water to improve washing performance. The washing machine includes a tub, a rotary tub rotatably provided inside of the tub, a tub cover coupled to the tub to prevent washing water from overflowing the tub, and a plurality of guide units formed on a bottom surface of the tub cover to guide the washing water into the inside of the rotary tub. The plurality of guide units includes a first guide having an outer end spaced from an edge of the tub cover in an inward direction of the tub cover, a second guide having an outer end spaced from the edge of the tub cover in the inward direction of the tub cover, and disposed to be spaced apart from the first guide in a circumferential direction of the tub cover, and a third guide connecting the outer end of the first guide and the outer end of the second guide.

11 Claims, 10 Drawing Sheets

(51) Int. Cl.

| | |
|---|---|
| ***D06F 37/40*** | (2006.01) |
| *D06F 37/42* | (2006.01) |
| *D06F 39/08* | (2006.01) |
| *D06F 23/04* | (2006.01) |

(52) U.S. Cl.
CPC ..... *D06F 37/265* (2013.01); *D06F 37/40* (2013.01); *D06F 23/04* (2013.01); *D06F 37/42* (2013.01); *D06F 39/08* (2013.01); *D06F 39/083* (2013.01)

(56) References Cited

FOREIGN PATENT DOCUMENTS

| | | |
|---|---|---|
| KR | 2000-0073893 | 12/2000 |
| KR | 2003-0055974 | 7/2003 |

OTHER PUBLICATIONS

Written Opinion of the International Search Authority dated Apr. 25, 2017 in corresponding International Patent Application No. PCT/KR2017/001273.

* cited by examiner

WASHING MACHINE

CROSS-REFERENCE TO RELATED APPLICATIONS

This application is a National Phase Application under 35 U.S.C. § 371 of PCT International Patent Application No. PCT/KR2017/001273, filed Feb. 6, 2017 which claims the foreign priority benefit under 35 U.S.C. § 119 to Korean Patent Application No. 10-2016-0016297 filed Feb. 12, 2016, the contents of which are incorporated herein by reference.

TECHNICAL FIELD

The present disclosure relates to a washing machine, and more particularly, to a washing machine having an improved structure for efficiently controlling a distribution of washing water to improve washing performance.

BACKGROUND ART

A washing machine is a home appliance for washing laundry using electric power. The washing machine includes a tub for storing washing water, a rotary tub rotatably installed in the tub, and a driving device for rotating the rotary tub, thereby washing the laundry mechanically.

The washing machine can be classified as a stirring type, a whirlpool type, or a drum type according to a washing method. A stirring type washing machine washes laundry by rotating an agitator standing in the center of the tub to the left and right. A whirlpool type washing machine washes laundry using streams of water generated by rotating a pulsator in the shape of a disk formed at the bottom of the rotary tub to the left and right. A drum type washing machine washes laundry by lifting and dropping the laundry by a plurality of lifters formed on the inner circumferential surface of the drum.

Generally, the stirring type washing machine and the whirlpool type washing machine are a top loading type in which laundry is loaded from the top, and the drum type washing machine is a front loading type in which laundry is loaded from the front.

In the whirlpool type washing machine, the washing water removes contaminants in the laundry while passing through the laundry by a centrifugal force generated in accordance with a rotation of the rotary tub, and is discharged to the outside of the rotary tub through a spin-drying hole. The washing water discharged to the outside of the rotary tub ascends on an inner wall of the tub and then flows back into the rotary tub. The whirlpool type washing machine repeats this process and performs washing and rinsing of the laundry.

The washing water ascending along the inner wall of the tub can be scattered by being hit to the rotating rotary tub. If the washing water is scattered as described above, the amount of the washing water flowing into the inside of the rotary tub may be reduced, thereby deteriorating the washing performance. In addition, the washing water may be scattered to the outside of the tub by being hit to the laundry or the rotary tub depending on the case, and such washing water may cause various leakage accidents and may threaten the safety of users. In addition, when the washing water flows into the rotary tub non-uniformly, it is difficult to expect effective washing of the laundry.

DISCLOSURE

Technical Problem

The present disclosure is directed to providing a washing machine having an improved structure for effectively guiding washing water into the inside of a rotary tub.

Further, the present disclosure is directed to providing a washing machine having an improved structure for uniformly supplying washing water to the inside of a rotary tub.

Further, the present disclosure is directed to providing a washing machine having an improved structure for efficiently distributing washing water in an inner region of a rotary tub.

Technical Solution

One aspect of the present disclosure provides a washing machine including a tub, a rotary tub rotatably provided inside of the tub, a tub cover coupled to the tub to prevent washing water from overflowing the tub, and a plurality of guide units formed on a bottom surface of the tub cover to guide the washing water into the inside of the rotary tub. The plurality of guide units may include a first guide having an outer end spaced from an edge of the tub cover in an inward direction of the tub cover, a second guide having an outer end spaced from the edge of the tub cover in the inward direction of the tub cover, and disposed to be spaced apart from the first guide in a circumferential direction of the tub cover, and a third guide connecting the outer end of the first guide and the outer end of the second guide.

An opening may be formed at the tub cover. The third guide may have a curvature larger than a curvature of the opening and smaller than a curvature of the edge of the tub cover.

The first guide and the second guide may extend from the opening toward the edge of the tub cover.

The washing machine may further include a balancer coupled to the rotary tub to compensate dynamic imbalance during a rotation of the rotary tub. The tub cover may include a first portion positioned in outer side of the tub cover and facing the balancer and a second portion positioned in inner side of the tub cover and in which the plurality of guide units is formed.

The plurality of guide units may be spaced apart from each other in the circumferential direction of the tub cover. A direction diversion rib may be formed between the plurality of guide units adjacent to each other such that the washing water rising along one wall of the tub by a rotation of the rotary tub is hit to the direction diversion rib and sprayed into the rotary tub.

One end of the direction diversion rib may meet with a first guide of one of the plurality of guide units facing each other, and the other end of the direction diversion rib may meet with a second guide of the other one of the plurality of guide units facing each other.

One of both ends of the direction diversion rib may be positioned in outer side of the tub cover than the other one of the both ends of the direction diversion rib.

When an angle (θ) formed by a tangent line (T) at one of a first intersection point (A), at which one end of the direction diversion rib and a first guide of one of the plurality of guide units meet, and a second intersection point (B), at which the other end of the direction diversion rib and a second guide of the other one of the plurality of guide units meet, and a straight line (L) connecting the first intersection point (A) and the second intersection point (B) is a direction diversion rib angle, at least one of the direction diversion rib may have a different direction diversion rib angle.

A first direction diversion rib and a second direction diversion rib having a different direction diversion rib angle may be alternately arranged.

At least one cushion rib may be formed on the bottom surface of the tub cover to be positioned in outer side of the tub cover than the third guide.

The at least one cushion rib may have a closed loop shape formed along the of the tub cover.

Another aspect of the present disclosure provides a washing machine including a tub, a rotary tub rotatably provided inside the tub, a tub cover coupled to the tub to prevent washing water rising along one wall of the tub facing the rotary tub by a rotation on the rotary tub from overflowing the tub and having an opening provided at inner side thereof, and a plurality of guides formed on a bottom surface of the tub cover to guide the washing water into the inside of the rotary tub. The plurality of guides may include a plurality of first direction guides extending from a boundary of the opening toward outer side in a radial direction of the tub cover and a plurality of second direction guides connecting the plurality of first direction guides adjacent to each other in a circumferential direction of the tub cover to form a closed loop shape.

At least one of the plurality of first direction guides may extend toward the outer side of the tub cover to meet an edge of the tub cover to partition the tub cover into at least one region.

The plurality of second direction guides may be formed radially inward of the tub cover to be spaced apart from an edge of the tub cover.

The plurality of second direction guides may have a curvature larger than a curvature of the opening and smaller than a curvature of the edge of the tub cover.

The plurality of first direction guides may include a first guide having a first point that meets the boundary of the opening and a second guide arranged alternately with the first guide and having a second point that meets the boundary of the opening. A degree of inclination of the first guide relative to a first reference line passing through the first point and extending toward the radial direction of the tub cover may be greater than a degree of inclination of the second guide relative to a second reference line passing through the second point and extending toward the radial direction of the tub cover.

One of the second guides adjacent to the first guide may be connected to the first guide by the plurality of second direction guides, and at least one direction diversion rib may be formed between the other one of the second guides adjacent to the first guide and the first guide so that the washing water rising along the one wall of the tub is hit to the at least one direction diversion rib and sprayed into the inside of the rotary tub.

Each of both ends of the at least one direction diversion rib may form an intersection with the other one of the second guides neighboring the first guide and the first guide, and one of the both ends of the at least one direction diversion rib may be positioned radially outward of the tub cover than the other of the both ends of the at least one direction diversion rib.

At least one cushion rib may be formed on the bottom surface of the tub cover to be positioned radially outward of the plurality of second direction guides. At least a portion of the at least one cushion rib may have a curvature.

The at least one cushion rib may have a closed loop shape formed along the circumferential direction of the tub cover.

Advantageous Effects

By forming a plurality of first direction guides on a bottom surface of a tub cover, washing water rising along on wall of a tub facing a rotary tub by a rotation of the rotary tub can be efficiently guided to the inside of the rotary tub.

By forming a plurality of second direction guides connecting a plurality of first direction guides adjacent to each other along a circumferential direction of a tub cover on a bottom surface of the tub cover, washing water can be uniformly supplied to the inside of the rotary tub even if the washing water rises unevenly along one wall of a tub.

By forming at least one cushion rib on a bottom surface of a tub cover, a role of a plurality of second direction guides can be maximized.

By forming at least one direction diversion rib on a bottom surface of a tub cover, a moving direction of washing water rising along one wall of a tub can be effectively changed toward laundry received in a rotary tub.

MODES OF THE INVENTION

Hereinafter, embodiments of the present disclosure will be described in detail with reference to the appended drawings. In the following description, the terms "front end", "rear end", "upper portion", "lower portion", "upper end", and "lower end" are defined based on the drawings, and the shapes and positions of the corresponding components are not limited by the terms.

Figure 1:
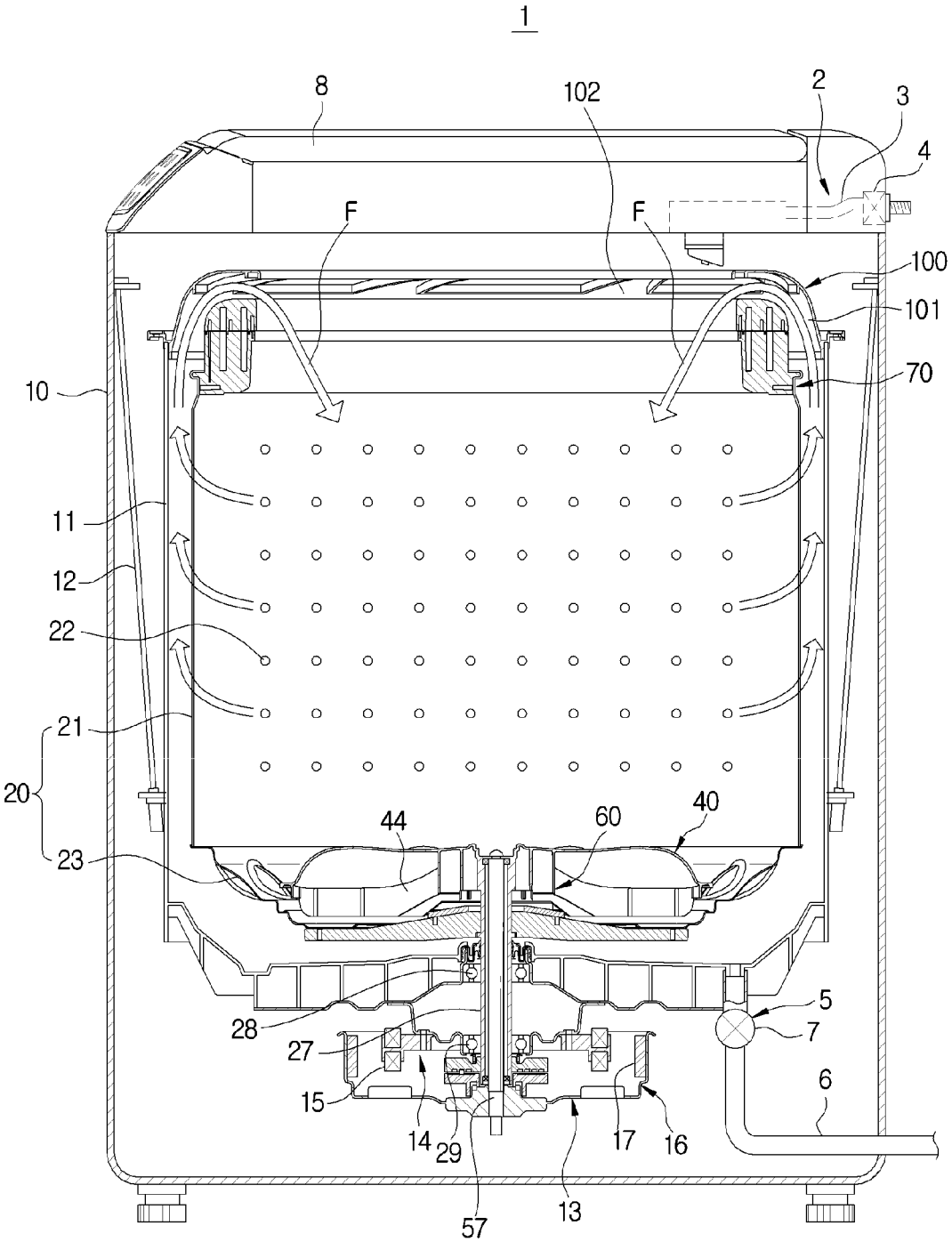
FIG. 1 is a cross-sectional view of a washing machine according to an embodiment of the present disclosure.

FIG. 1 is a cross-sectional view of a washing machine according to an embodiment of the present disclosure. FIG. 1 shows a washing machine 1 to which a first tub cover 100 is applied. Hereinafter, an upstream of a washing water moving direction F (hereinafter referred to as a washing water moving direction F) in which washing water rising along one wall of a tub 11 flows into the inside of a rotary tub 20 may refer to the same direction as outer side of the tub cover 100. In addition, a downstream of the washing water moving direction F may refer to the same direction as inner side of the tub cover 100.

As shown in FIG. 1, a washing machine 1 may include a main body 10 forming an outer appearance of the washing machine 1, a tub 11 disposed inside the main body 10 for storing washing water, a rotary tub 20 rotatably installed in the tub 11, a pulsator 40 rotatably installed at a lower portion of the rotary tub 20 to generate washing water stream, and a motor 13 generating a driving force. The washing machine 1 may further include a clutch device 60 that selectively transmits the driving force of the motor 13 to the pulsator 40 or transmits the driving force of the motor 13 to the pulsator 40 and the rotary tub 20.

The main body 10 may have a substantially box shape with its top surface opened. A door 8 may be coupled to the main body 10 to open or close the opened top surface. The door 8 may be hinged to the main body 10 to be rotatable.

The tub 11 may be installed inside the main body 10 through a suspension device 12. The tub 11 may have a substantially cylindrical shape. A water supply device 2 for supplying the washing water to the tub 11 may be provided above the tub 11, and a water drainage device 5 for discharging the washing water of the tub 11 to the outside of the main body 10 may be provided under the tub 11. The water supply device 2 may include a water supply pipe 3 connected to an external water supply source (not shown) and a water supply valve 4 to open or close the water supply pipe 3. The water drainage device 5 may include a water drainage pipe 6 and a water drainage valve 7 to open or close the water drainage pipe 6.

The rotary tub 20 may include a cylindrical portion 21 having a cylindrical shape and a bowl portion 23 coupled to a lower portion of the cylindrical portion 21. The cylindrical portion 21 may be provided with a through hole 22 so that the washing water of the tub 11 can be introduced or discharged. The bowl portion 23 may form a bottom of the rotary tub 20. In addition, the bowl portion 23 may include a hollow (not shown) through which a washing shaft 57 and a spin-drying shaft 27 pass.

The motor 13 may include a stator 14 fixed to a bottom surface of the tub 11 and a rotor 16 rotating in a normal direction and a reverse direction in cooperation with the stator 14. The rotor 16 may be disposed radially outward of the stator 14. The stator 14 may include a coil 15 that generates a magnetic field when an electric current is applied, and the rotor 16 may include a magnet 17 that interacts with the coil 15. A lower end of the washing shaft 57 may be coupled to the center of the rotor 16 so that the washing shaft 57 can rotate together with the rotor 16 when the rotor 16 rotates. At an upper end of the washing shaft 57, the pulsator 40 generating the washing water stream may be coupled. Therefore, the washing shaft 57 can transmit a rotational force generated by the motor 13 to the pulsator 40. The washing shaft 57 may be rotatably supported by bearings 28 and 29.

The pulsator 40 may be rotatably provided at a lower portion of the rotary tub 20. The pulsator 40 may be rotatably supported by the washing shaft 57. The pulsator 40 may have a substantially disc shape. A shaft coupling portion (not shown) may be formed at the center of the pulsator 40 to couple the washing shaft 57 thereto. On an upper surface of the pulsator 40, a rotary vane 44 may be formed radially to generate the washing water stream when the pulsator 40 rotates.

The washing shaft 57 may be provided inside the spin-drying shaft 27. That is, the spin-drying shaft 27 may have a hollow and the washing shaft 57 may be inserted through the hollow of the spin-drying shaft 27.

The washing machine 1 may further include a tub cover 100. The tub cover 100 may be coupled to the tub 11 to prevent the washing water from overflowing to the outside of the tub 11. The tub cover 100 may be coupled to the tub 11 to supply washing water that has risen through a gap between the tub 11 and the rotary tub 20 by the rotation of the rotary tub 20 to the rotary tub 20. In other words, the tub cover 100 may be coupled to the tub 11 to prevent the washing water that has risen along one wall of the tub 11 facing the rotary tub 20 by the rotation of the rotary tub 20 from overflowing to the outside of the tub 11. The tub cover 100 may be coupled to an upper portion of the tub 11.

The tub cover 100 may include a first portion 101. The first portion 101 may be positioned in the upstream of the washing water moving direction F, and may face a balancer 70. In other words, the first portion 101 may be positioned in outer side of the tub cover 100, and may face the balancer 70.

The tub cover 100 may further include a second portion 102. The second portion 102 may be positioned in the downstream of the washing water moving direction F, and a plurality of guide units may be formed therein. In other words, the second portion 102 may be positioned in inner side of the tub cover 100, and the plurality of guide units may be formed therein.

An opening 104 (see FIG. 2) may be formed at the tub cover 100. The opening 104 may be formed at inner side of the tub cover 100. The laundry may be introduced into the rotary tub 20 through the opening 104 of the tub cover 100.

The washing machine 1 may further include the balancer 70. The balancer 70 may be coupled to the rotary tub 20 to compensate dynamic imbalance during a rotation of the rotary tub 20. An unbalanced phenomenon may occur in a case in which a center of gravity of the rotary tub 20 does not coincide with a center of rotation of the rotary tub 20 when the rotary tub 20 rotates, or the laundry is not uniformly distributed in the rotary tub 20. The unbalanced phenomenon that occurs with respect to the rotary tub 20 may cause a large vibration or noise when the washing machine 1 is driven. In order to prevent such an unbalanced phenomenon, the balancer 70 may be installed at the rotary tub 20. The balancer 70 may have a ring shape and may be installed at an upper portion of the rotary tub 20 along a circumference of the rotary tub 20.

The washing water passes through the laundry by a centrifugal force generated in accordance with the rotation of the rotary tub 20 and removes contaminants in the laundry, and then is discharged to the outside of the rotary tub 20 through the through hole 22. The washing water discharged to the outside of the rotary tub 20 rises on an inner wall of the tub 11 and then flows back into the rotary tub 20. The washing machine 1 performs washing and rinsing of the laundry while repeating the above process.

The washing machine 1 may further include a washing water guide structure formed on the bottom surface of the tub cover 100 to guide the washing water into the rotary tub 20. The washing water guide structure may be a concept including a plurality of guide units, a plurality of guides 110, 120 and 130, at least one direction diversion rib 160 and at least one cushion rib 190. The washing water guide structure may be integrally formed with the tub cover 100.

If the washing water guide structure is not formed on the bottom surface of the tub cover 100, the washing water rising along the inner wall of the tub 11 may be scattered to the outside of the tub 11, thereby lowering a washing efficiency. In addition, it may cause various safety accidents including an electric shock accident caused by leakage of the washing water. Therefore, a shape of the washing water guide structure to guide the washing water into the rotary tub 20 is very important.

Hereinafter, the washing water guide structure formed on the bottom surface of the tub cover 100 will be described in detail.

Figure 2:
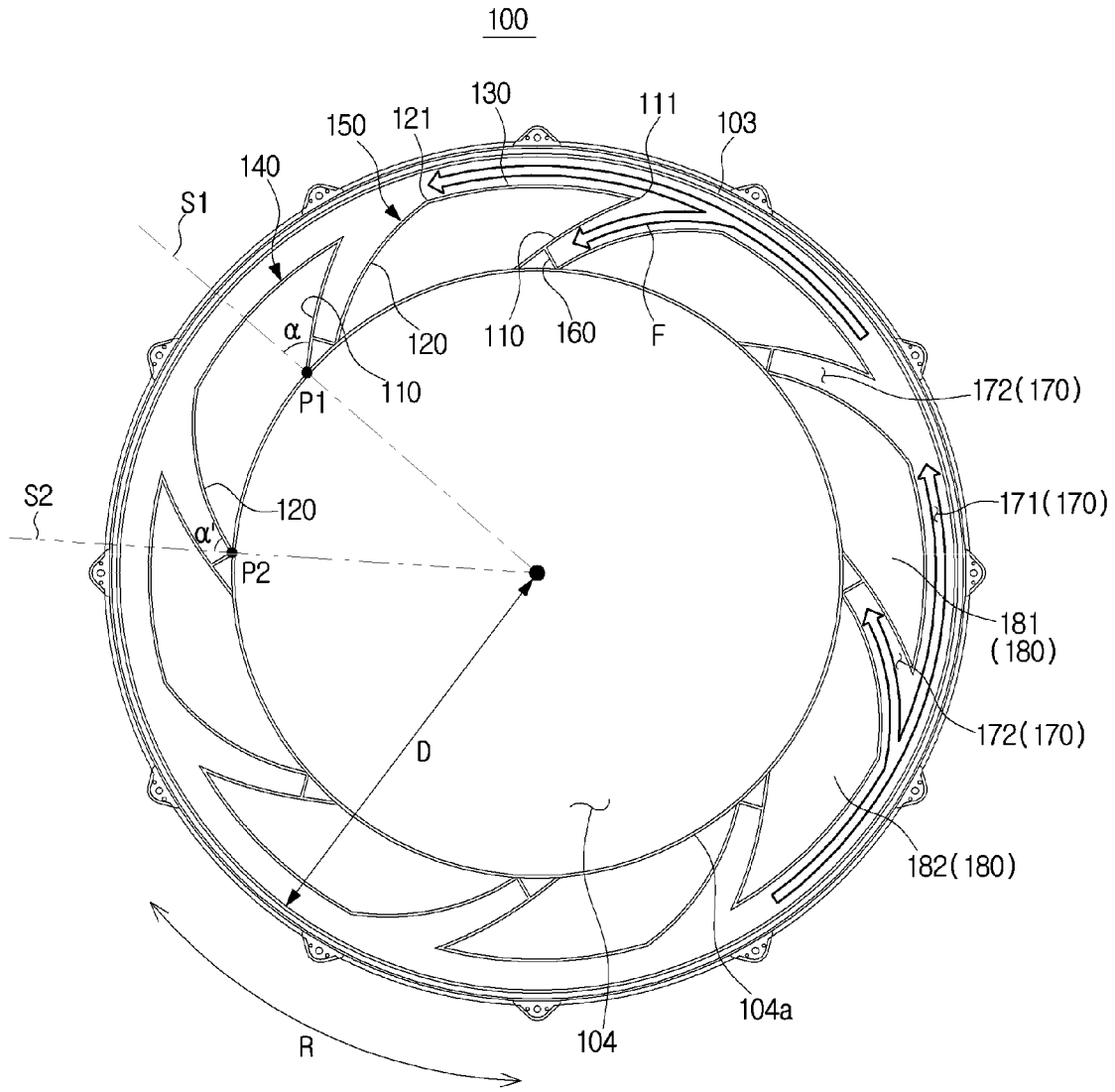
FIG. 2 is a view showing a first tub cover of the washing machine according to an embodiment of the present disclosure.
Figure 3:
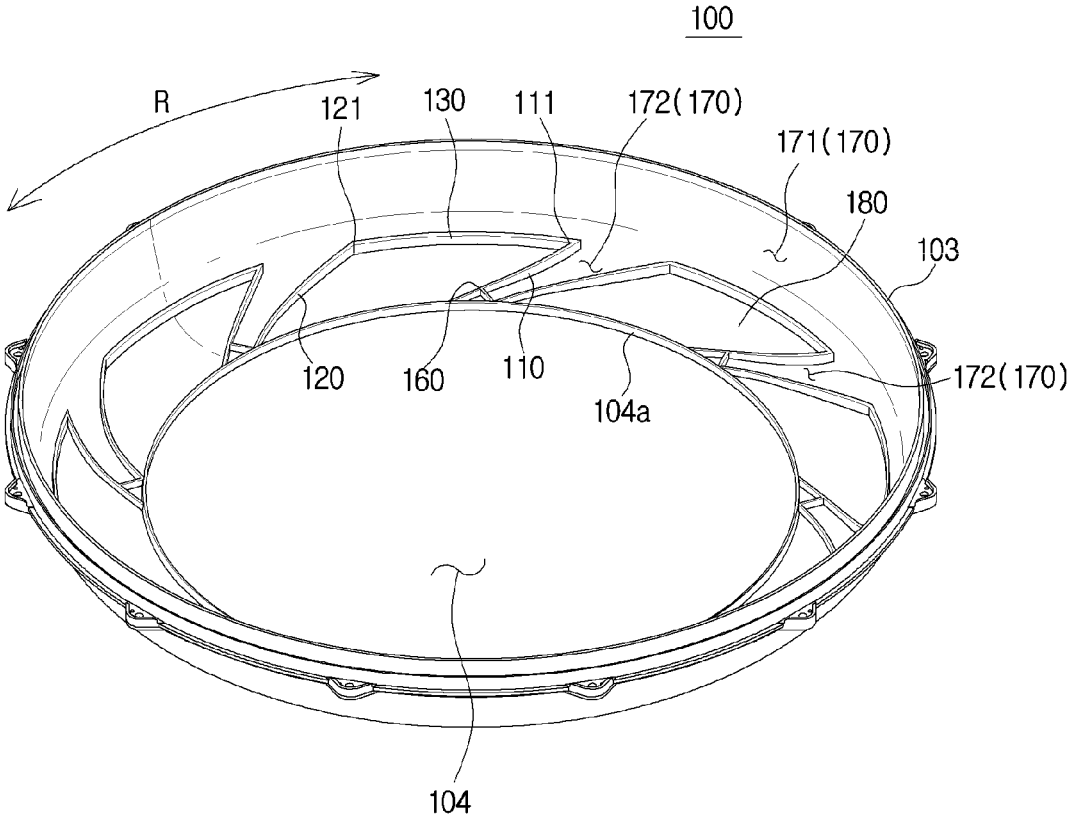
FIG. 3 is a view showing the first tub cover at an angle different from that of FIG. 2.

FIG. 2 is a view showing a first tub cover of the washing machine according to an embodiment of the present disclosure, and FIG. 3 is a view showing the first tub cover at an angle different from that of FIG. 2. Hereinafter, reference numerals not shown will be referred to FIG. 1. Hereinafter, as an example, a case in which the tub cover 100 has a circular shape will be mainly described. A radial direction D and a circumferential direction R are provided when it is assumed that the tub cover 100 has the circular shape. However, a shape of the tub cover 100 is not limited to the circular shape, but can be variously modified.

As shown in FIGS. 2 and 3, the washing machine 1 may further include a plurality of guide units formed on the bottom surface of the tub cover 100 to guide the washing water into the rotary tub 20.

The plurality of guide units may include a first guide 110.

The first guide 110 may extend from the opening 104 toward an edge 103 of the tub cover 100. The first guide 110 may extend in the radial direction D of the tub cover 100.

At least a portion of the first guide 110 may include a curved portion.

The first guide 110 may include an outer end 111. The outer end 111 of the first guide 110 may be spaced from the edge 103 of the tub cover 100 to be positioned in the inner side of the tub cover 100. Further, the first guide 110 may further include an inner end. The inner end of the first guide 110 may meet the opening 104.

The plurality of guide units may further include a second guide 120 disposed to be spaced apart from the first guide 110 in the circumferential direction R of the tub cover 100. In other words, the second guide 120 may be formed on the bottom surface of the tub cover 100 so that the second guide 120 is spaced apart from the first guide 110 in the circumferential direction R of the tub cover 100.

The second guide 120 may extend from the opening 104 toward the edge 103 of the tub cover 100. The second guide 120 may extend in the radial direction D of the tub cover 100.

At least a portion of the second guide 120 may include a curved portion.

The second guide 120 may include an outer end 121. The outer end 121 of the second guide 120 may be spaced from the edge 103 of the tub cover 100 to be positioned in the inner side of the tub cover 100. Further, the second guide 120 may further include an inner end. The inner end of the second guide 120 may meet the opening 104.

The plurality of guide units may further include a third guide 130 formed between the first guide 110 and the second guide 120. The third guide 130 may connect the first guide 110 and the second guide 120 in the circumferential direction R of the tub cover 100. In other words, the third guide 130 may connect the first guide 110 and the second guide 120 in the circumferential direction R of the tub cover 100.

The third guide 130 may connect the outer end 111 of the first guide 110 and the outer end 121 of the second guide 120. In other words, the third guide 130 may connect the outer end 111 of the first guide 110 positioned in the upstream of the washing water moving direction F and the outer end 121 of the second guide 120 positioned in the upstream of the washing water moving direction F. In other words, the third guide 130 may connect the outer end 111 of the first guide 110 toward the outer side of the radial direction D of the tub cover 100 and the outer end 121 of the second guide 120 toward the outer side of the radial direction D of the tub cover 100 in the circumferential direction R of the tub cover 100.

The third guide 130 may be formed on the bottom surface of the tub cover 100 so that the third guide 130 is spaced apart from the edge 103 of the tub cover 100 toward the downstream in the washing water moving direction F. The third guide 130 may be spaced apart from the edge 103 of the tub cover 100 toward the downstream in the washing water moving direction F so that a predetermined amount of washing water rising along the one wall of the tub 11 flows along the third guide 130 between the edge 103 of the tub cover 100 and the third guide 130. In other words, the first guide 110 and the second guide 120 may be extended from the opening 104 toward the edge 103 of the tub cover 100 so that the outer end 111 of the first guide 110 and the outer end 121 of the second guide 120 are spaced apart from the edge 103 of the tub cover 100 toward the downstream in the washing water moving direction F.

At least a portion of the third guide 130 may have a curvature.

The third guide 130 may have a curvature greater than the curvature of the opening 104.

The third guide 130 may have a smaller curvature than the curvature of the edge 103 of the tub cover 100.

Preferably, the third guide 130 may have a curvature which is larger than a curvature of the opening 104 and smaller than a curvature of the tub cover 100.

The plurality of guide units may be spaced apart from each other in the circumferential direction R of the tub cover 100. A direction diversion rib 160 may be formed between the plurality of guide units adjacent to each other so that the washing water rising along the one wall of the tub 11 is hit to the direction diversion rib 160 and sprayed into the inside of the rotary tub 20. Hereinafter, for convenience of description, it is assumed that the plurality of guide units include a first guide unit 140 and a second guide unit 150. It is assumed that the first guide unit 140 and the second guide unit 150 are adjacent to each other.

Each of both ends of the direction diversion rib 160 may meet with a first guide 110 of one of the plurality of guide units facing to each other and a second guide 120 of the other one of the plurality of guide units facing to each other. In other words, when the direction diversion rib 160 is positioned between the first guide unit 140 and the second guide unit 150, the each of the both ends of the direction diversion rib 160 may meet with the first guide 110 of the first guide unit 140 and the second guide 120 of the second guide unit 150.

Preferably, one end of the direction diversion rib 160 may meet with one of an intersection at which a boundary **104*a* of the opening 104 and the first guide 110 meet with each other and an intersection at which the boundary 104*a* of the opening 104 and the second guide 120 meet with each other. The other end of the direction diversion rib 160 may meet with the first guide 110 or the second guide 120. At this time, the other end of the direction diversion rib 160 may be positioned between the outer end 111 of the first guide 110 and the inner end of the first guide 110 or between the outer end 121 of the second guide 120 and the inner end of the second guide 120**.

One of the both ends of the direction diversion rib 160 may be positioned in the outer side of the tub cover 100 than the other one. In other words, one of the both ends of the direction diversion rib 160 may be positioned in the upstream of the washing water moving direction F than the other one.

Gap sizes between the plurality of guide units may be all the same.

Alternatively, at least a part of the gap sizes between the plurality of guide units may be different.

In other respects, the washing machine 1 may include a plurality of guides 110, 120 and 130 formed on the bottom surface of the tub cover 100 to guide the washing water into the rotary tub 20.

The plurality of guides 110, 120 and 130 may include a plurality of first direction guides 110 and 120.

The plurality of first direction guides 110 and 120 may extend from the boundary 104*a* of the opening 104 toward the outer side of the tub cover 100. That is, the plurality of guides 110, 120 and 130 may extend from the boundary 104*a* of the opening 104 toward the outer side of the radial direction D of the tub cover 100.

The plurality of first direction guides 110 and 120 may include a first guide 110 and a second guide 120.

The first guide 110 may have a first point P1 that meets with the boundary 104*a* of the opening 104. The second guide 120 may have a second point P2 that meets with the boundary 104*a* of the opening 104. The second guide 120 may be disposed alternately with the first guide 110 along the circumferential direction R of the tub cover 100.

An inclination of the first guide 110 and an inclination of the second guide 120 may be different from each other. Particularly, a degree to which the first guide 110 is inclined with respect to a first reference line S1 extending toward the radial direction D of the tub cover 100 and passing through the first point P1 may be larger than a degree to which the second guide 120 is inclined with respect to a second reference line S2 extending toward the radial direction D of the tub cover 100 and passing through the second point P2.

The inclination of the first guide 110 and the inclination of the second guide 120 may be the same.

The plurality of guides 110, 120 and 130 may further include a plurality of second direction guides 130.

The plurality of second direction guides 130 may be formed in the inner side of the tub cover 100 to be spaced apart from the edge 103 of the tub cover 100. That is, the plurality of second direction guides 130 may be formed on the tub cover 100 to be spaced apart from the edge 103 of the tub cover 100 toward the inner side of the radial direction D of the tub cover 100.

The plurality of second direction guides 130 may form a closed loop shape by connecting a plurality of first direction guides 110 and 120 adjacent to each other in the circumferential direction R of the tub cover 100.

Preferably, the plurality of second direction guides 130 may have a curvature which is larger than a curvature of the opening 104 and smaller than a curvature of the edge 103 of the tub cover 100.

One of the plurality of second guides 120 adjacent to the first guide 110 may be connected to the first guide 110 by the plurality of second direction guides 130. At least one direction diversion rib 160 may be formed between the other one of the plurality of second guides 120 adjacent to the first guide 110 and the first guide 110 so that the washing water rising along the one wall of the tub 11 is hit to the at least one direction diversion rib 160 and sprayed into the inside of the rotary tub 20.

Each of both ends of the at least one direction diversion rib 160 may form an intersection with the other one of the second guide 120 neighboring the first guide 110 and the first guide 110.

One of the both ends of the at least one direction diversion rib 160 may be positioned in outer side of the radial direction D of the tub cover 100 than the other one of the both ends of the at least one direction diversion rib 160.

In another aspect, the washing machine 1 may further include a flow path 170 formed on the bottom surface of the tub cover 100 to guide the washing water into the inside of the rotary tub 20.

The flow path 170 may include an outer flow path 171. The outer flow path 171 may be formed along the circumferential direction R of the tub cover 100. The outer flow path 171 may be continuous along the circumferential direction R of the tub cover 100. The outer flow path 171 may have a closed loop shape disposed along the circumferential direction R of the tub cover 100. For example, the outer flow path 171 may have a ring shape disposed along the circumferential direction R of the tub cover 100.

The flow path 170 may further include a plurality of inner flow paths 172. The plurality of inner flow paths 172 may be branched at the outer flow path 171 to guide the washing water to the opening 104.

The washing machine 1 may further include a plurality of blocks 180. The plurality of blocks 180 may be positioned between the plurality of inner flow paths 172 to partition the plurality of inner flow paths 172. The plurality of blocks 180 may be surrounded by the outer flow path 171 and the plurality of inner flow paths 172. In addition, the plurality of blocks 180 may be formed along a circumferential direction of the opening 104.

The plurality of blocks 180 may have a closed loop shape including the boundary 104*a* of the opening 104.

The direction diversion rib 160 may be formed in the plurality of inner flow paths 172 so that the washing water flowing along the plurality of inner flow paths 172 is hit to the direction diversion rib 160 and sprayed into the rotary tub 20.

The plurality of blocks 180 may include a first block 181 and a second block 182 facing each other with respect to one of the plurality of inner flow paths 172. The direction diversion rib 160 may be disposed to traverse one of the plurality of inner flow paths 172 disposed between the first block 181 and the second block 182. Each of the both ends of the direction diversion rib 160 may meet with the first block 181 and the second block 182.

A role of the plurality of first direction guides 110 and 120, the plurality of second direction guides 130, and the at least one direction diversion rib 160 will be described with reference to the washing water.

The plurality of second direction guides 130 may guide the washing water rising along the one wall of the tub 11 facing the rotary tub 20 by the rotation of the rotary tub 20 in the circumferential direction R of the tub cover 100. The plurality of first direction guides 110 and 120 may guide the washing water flowing in the circumferential direction R of the tub cover 100 along the plurality of second direction guides 130 toward the inner side of the radial direction D of the tub cover 100. The at least one direction diversion rib 160 may convert a direction of the washing water flowing along the plurality of first direction guides 110 and 120 into a gravity direction G so that the washing water can be supplied to the laundry in the rotary tub 20.

A distribution of the washing water rising along the one wall of the tub 11 by the rotation of the rotary tub 20 may be not uniform in the circumferential direction R of the tub cover 100 due to a non-uniform shape of the lower portion of the tub 11 and an uneven spacing between the tub 11 and the rotary tub 20 or the like. Such uneven distribution of the washing water may lead to irregular supply of the washing water to the inside of the rotary tub 20, which may deteriorate washing performance of the washing machine 1. In order to solve the above described problems, a washing water holding structure, that is, the plurality of second direction guides 130, may be formed on the bottom surface of the tub cover 100. When the plurality of second direction guides 130 are formed on the bottom surface of the tub cover 100, even if the distribution of the washing water rising along the one wall of the tub 11 by the rotation of the rotary tub 20 is not uniform, the washing water may be uniformly supplied into the rotary tub 20 by collecting a predetermined amount of uneven washing water.

Figure 4:
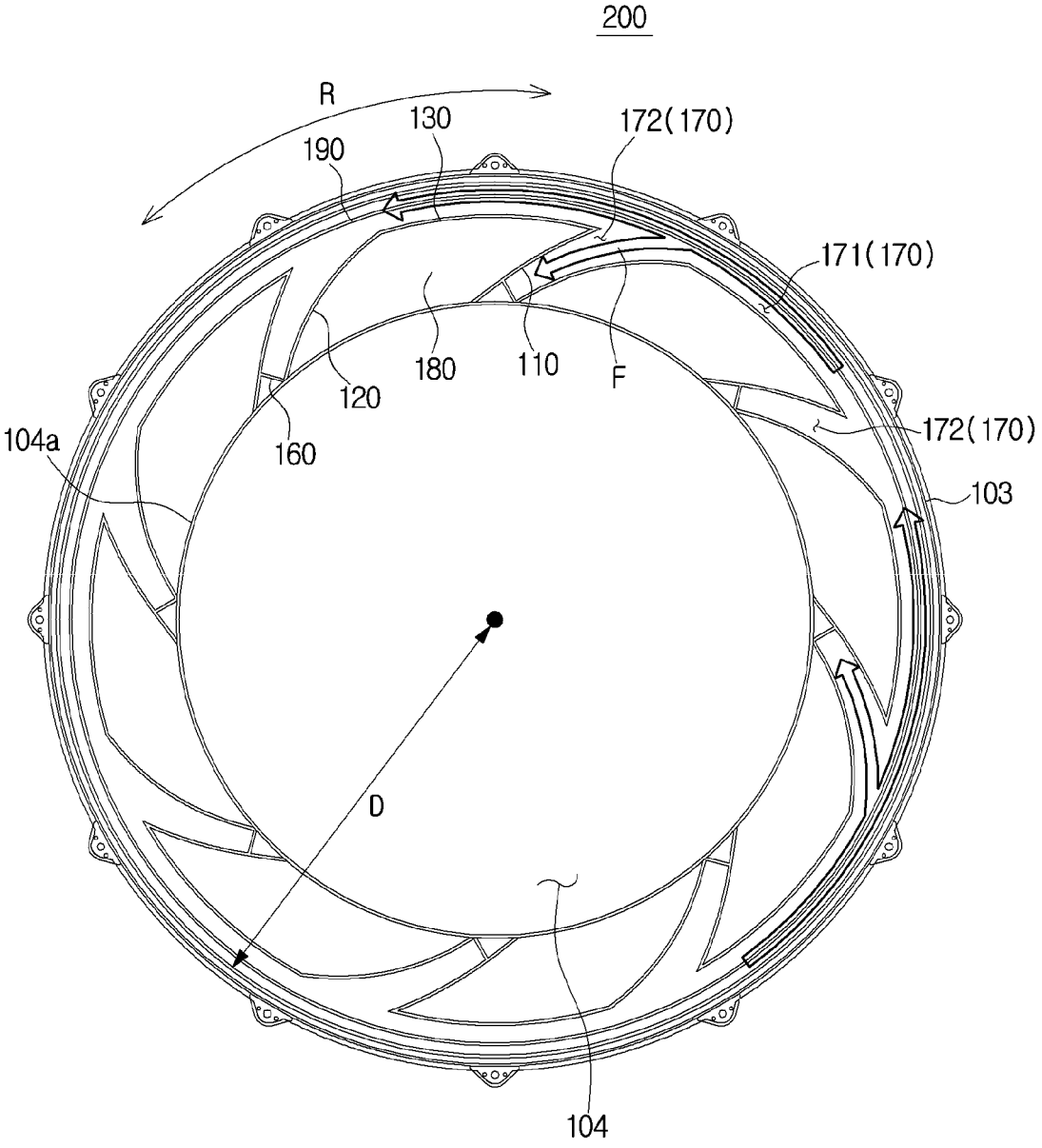
FIG. 4 is a view showing a second tub cover of the washing machine according to an embodiment of the present disclosure.
Figure 5:
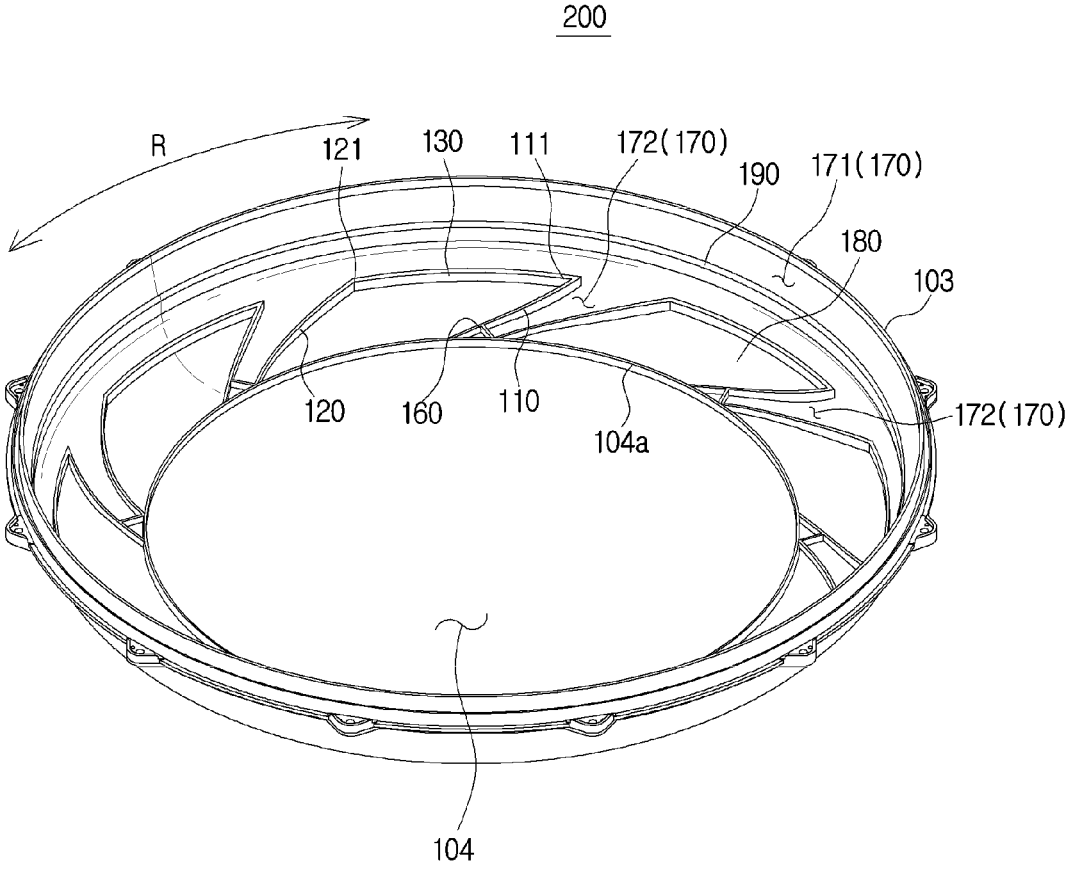
FIG. 5 is a view showing the second tub cover at an angle different from that of FIG. 4.
Figure 6:
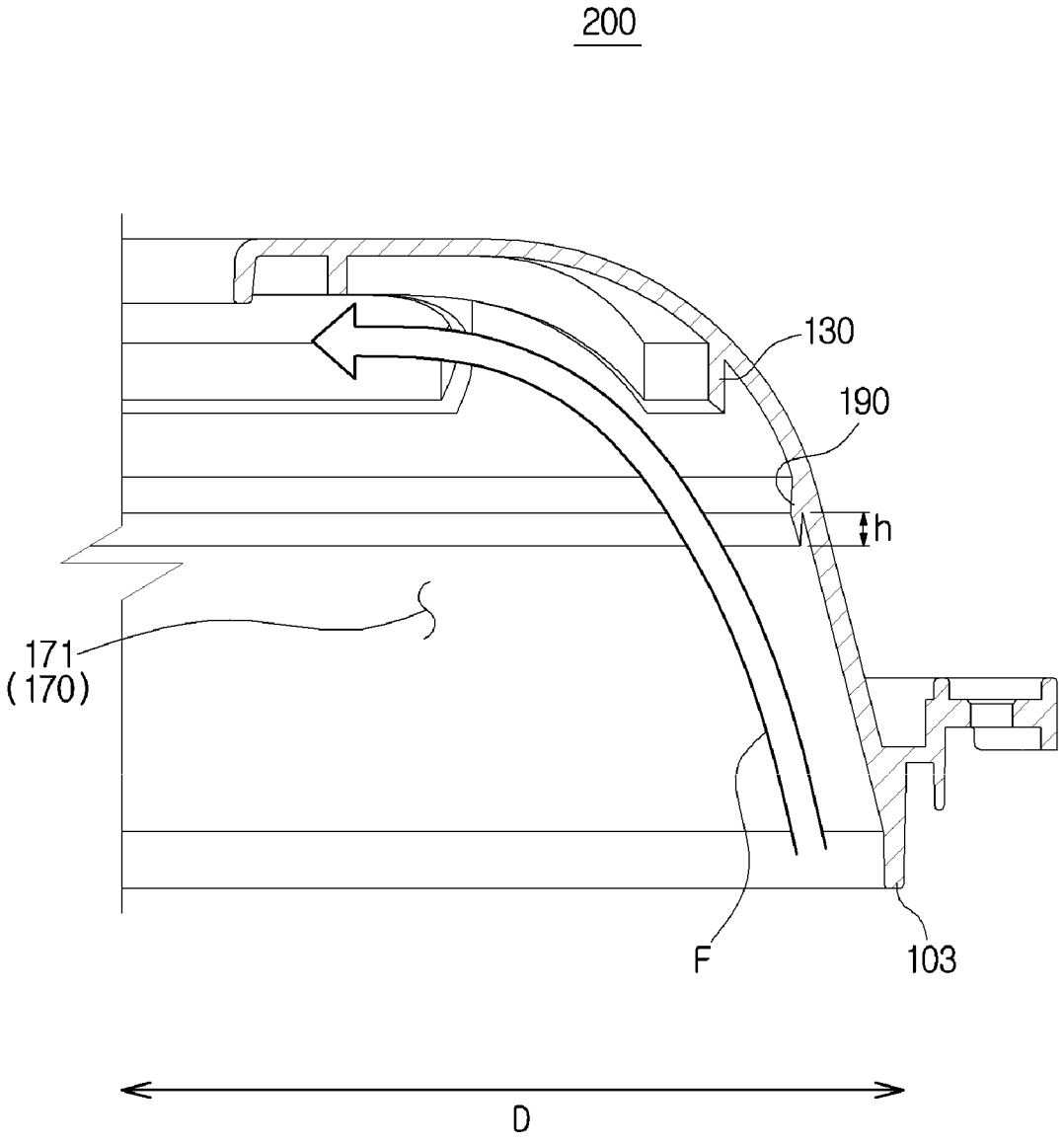
FIG. 6 is a cross-sectional view of the second tub cover shown in FIG. 4.

FIG. 4 is a view showing a second tub cover of the washing machine according to an embodiment of the present disclosure, and FIG. 5 is a view showing the second tub cover at an angle different from that of FIG. 4. FIG. 6 is a cross-sectional view of the second tub cover shown in FIG. 4. Hereinafter, reference numerals not shown will be referred to FIG. 1. Hereinafter, a description overlapping with a description of the first tub cover 100 may be omitted. A "h" shown in FIG. 6 means a height of at least one cushion rib 190.

As shown in FIGS. 4 to 6, at least one cushion rib 190 may be formed on the bottom surface of a tub cover 200 to be positioned in the outer side of the tub cover 200 than the third guide 130.

At least a part of the at least one cushion rib 190 may have a curvature.

At least a part of one cushion rib 190 may have a curvature.

The at least one cushion rib 190 may have a closed loop shape formed along the circumferential direction R of the tub cover 200. As an example, the at least one cushion rib 190 may have a ring shape formed along the circumferential direction R of the tub cover 200.

Figure 7:
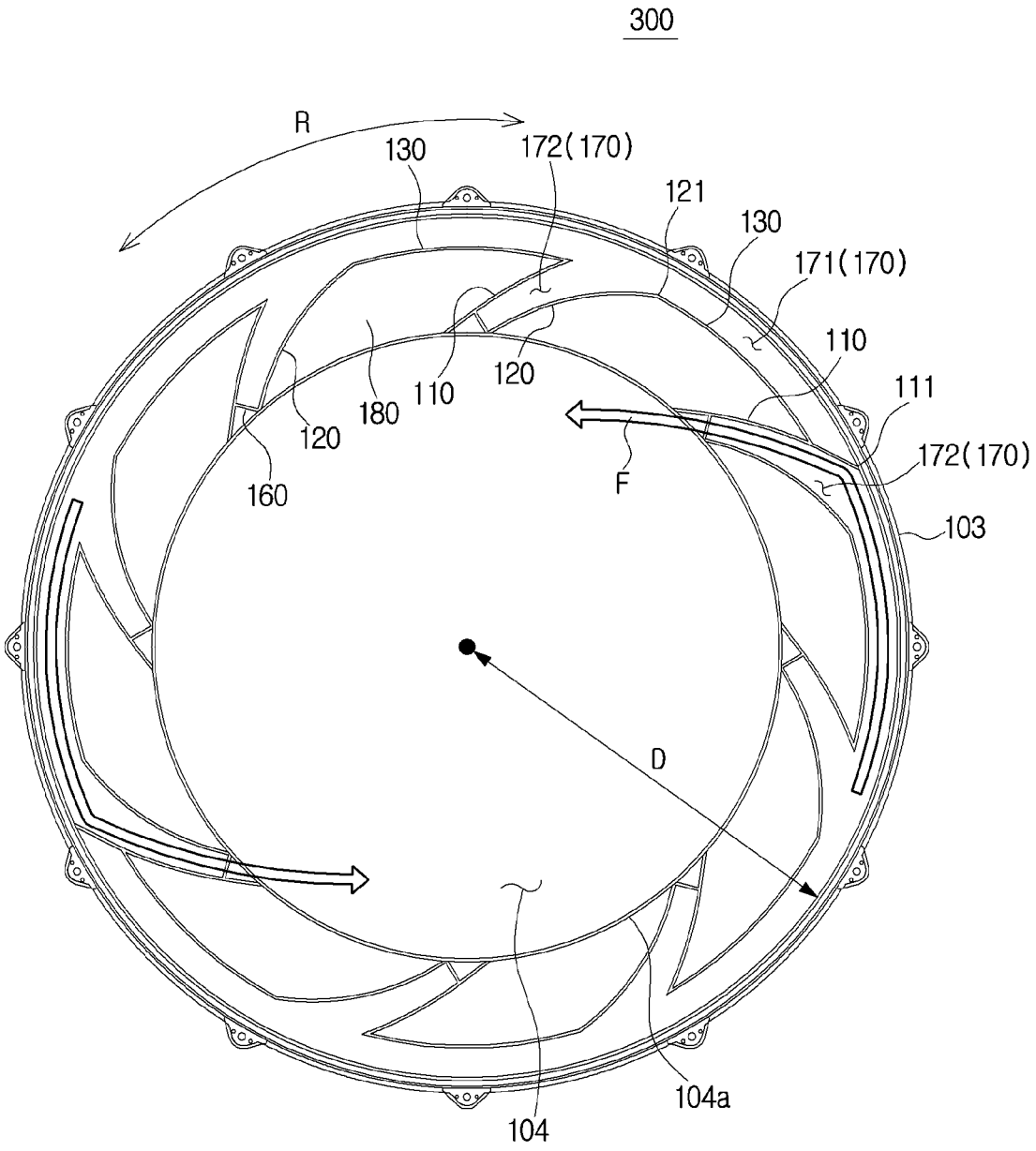
FIG. 7 is a view showing a third tub cover of the washing machine according to an embodiment of the present disclosure.
Figure 8:
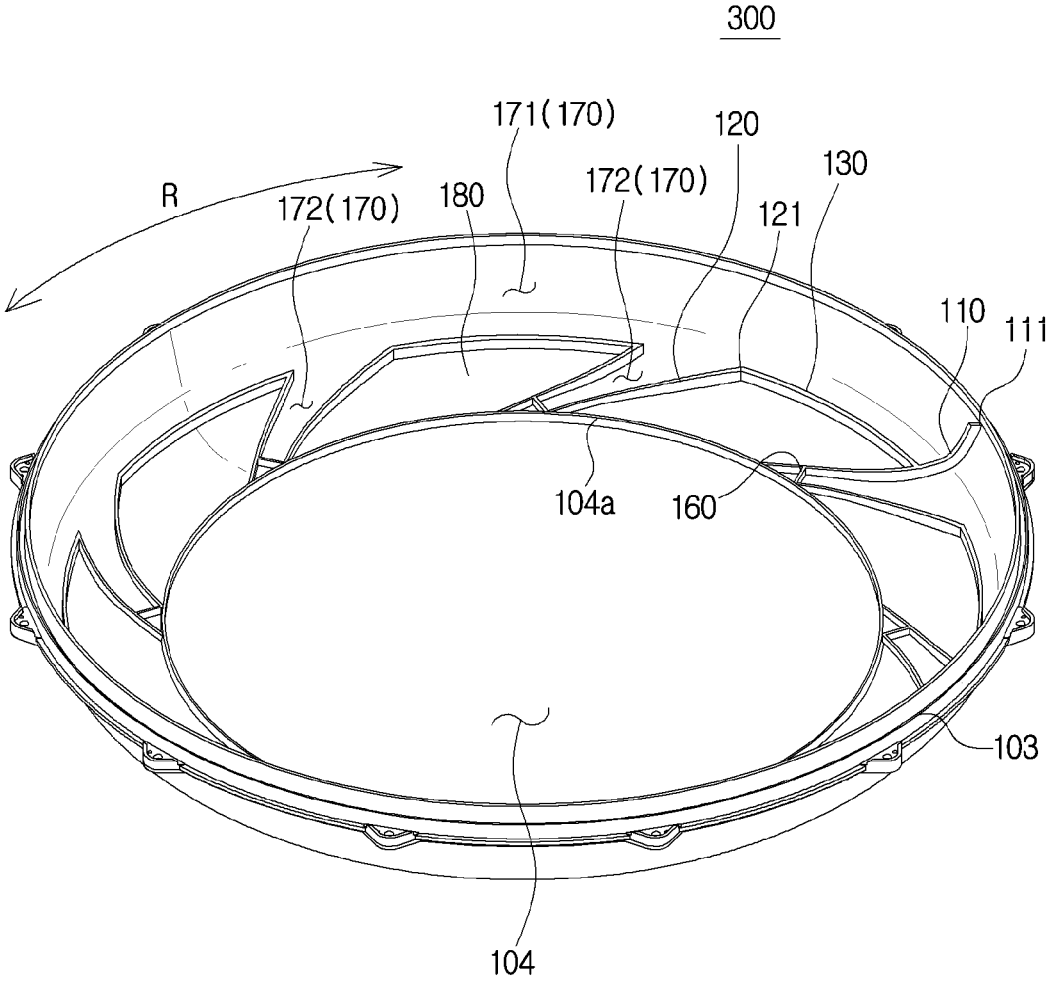
FIG. 8 is a view showing the third tub cover at an angle different from that of FIG. 7.

FIG. 7 is a view showing a third tub cover of the washing machine according to an embodiment of the present disclosure, and FIG. 8 is a view showing the third tub cover at an angle different from that of FIG. 7. Hereinafter, reference numerals not shown will be referred to FIG. 1. Hereinafter, a description overlapping with a description of the first tub cover 100 may be omitted.

As shown in FIGS. 7 and 8, at least one of the plurality of first direction guides 110 and 120 may extend toward the outer side of a tub cover 300 to partition the tub cover 300 into at least one region. Particularly, the at least one of the plurality of first direction guides 110 and 120 may extend toward the outer side of the tub cover 300 to meet the edge 103 of the tub cover 300. A washing water distribution amount can be locally controlled by a region partition of the tub cover 300 or a region division of the tub cover 300. That is, a distribution of the washing water supplied to the inside of the rotary tub 20 through the region partition of the tub cover 300 or the region division of the tub cover 300 may vary for each region of the tub cover 300.

Figure 9:
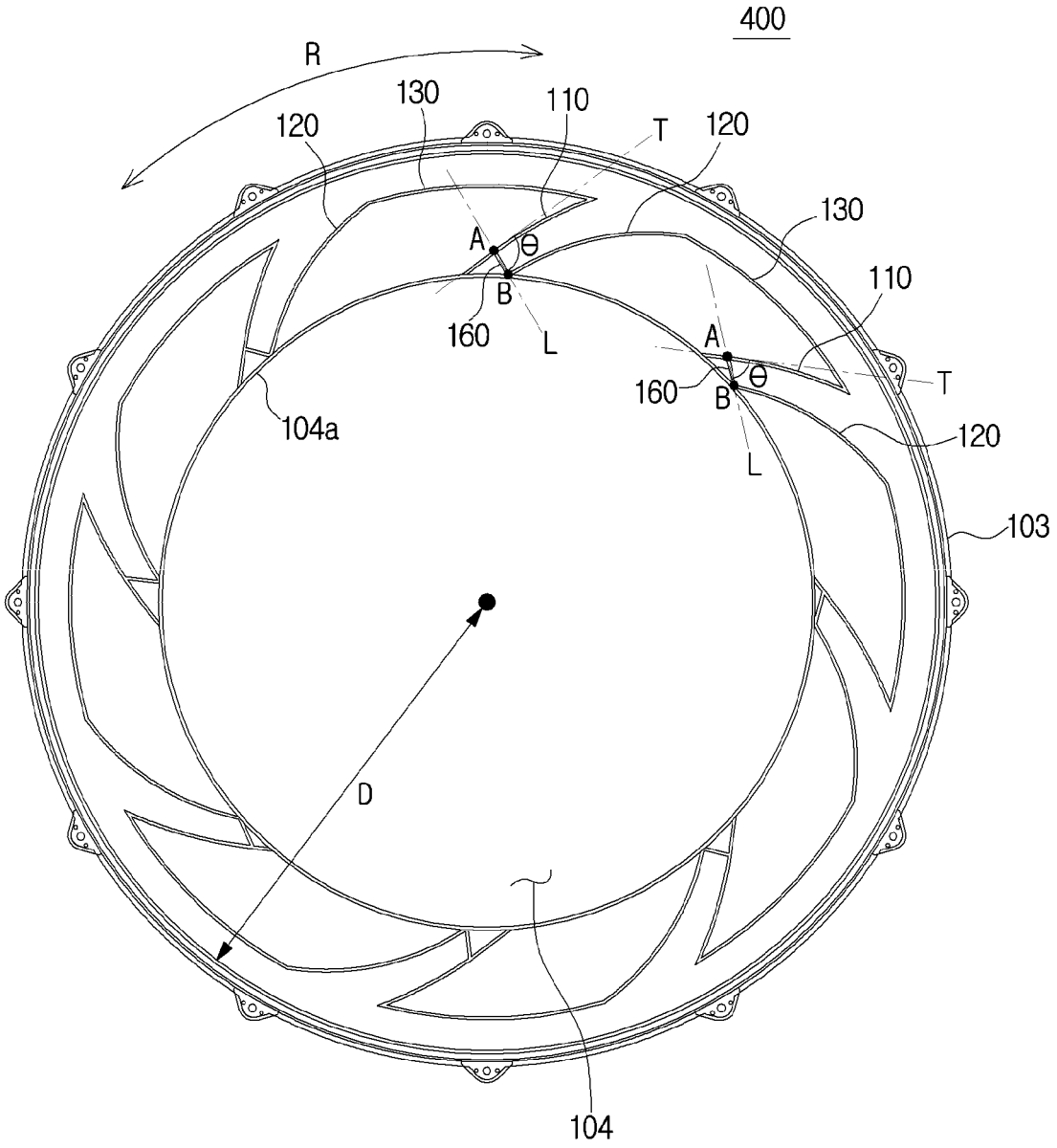
FIG. 9 is a view showing a fourth tub cover of the washing machine according to an embodiment of the present disclosure.

FIG. 9 is a view showing a fourth tub cover of the washing machine according to an embodiment of the present disclosure. Hereinafter, reference numerals not shown will be referred to FIG. 1. Hereinafter, a description overlapping with a description of the first tub cover 100 may be omitted.

As shown in FIG. 9, at least one angle of the plurality of direction diversion ribs 160 formed on the bottom surface of a tub cover 400 may be different.

When an angle (θ) formed by a tangent line (T) at one of a first intersection point (A), at which one end of the direction diversion rib 160 and the first guide 110 of one of the plurality of guide units meet, and a second intersection point (B), at which the other end of the direction diversion rib 160 and a second guide 120 of the other one of the plurality of guide units meet, and a straight line (L) connecting the first intersection point (A) and the second intersection point (B) is a direction diversion rib angle, at least one of the direction diversion rib 160 may have a different direction diversion rib angle.

It is also possible that a direction diversion rib angles of the direction diversion ribs 160 formed on the bottom surface of the tub cover 400 are all the same.

Figure 10:
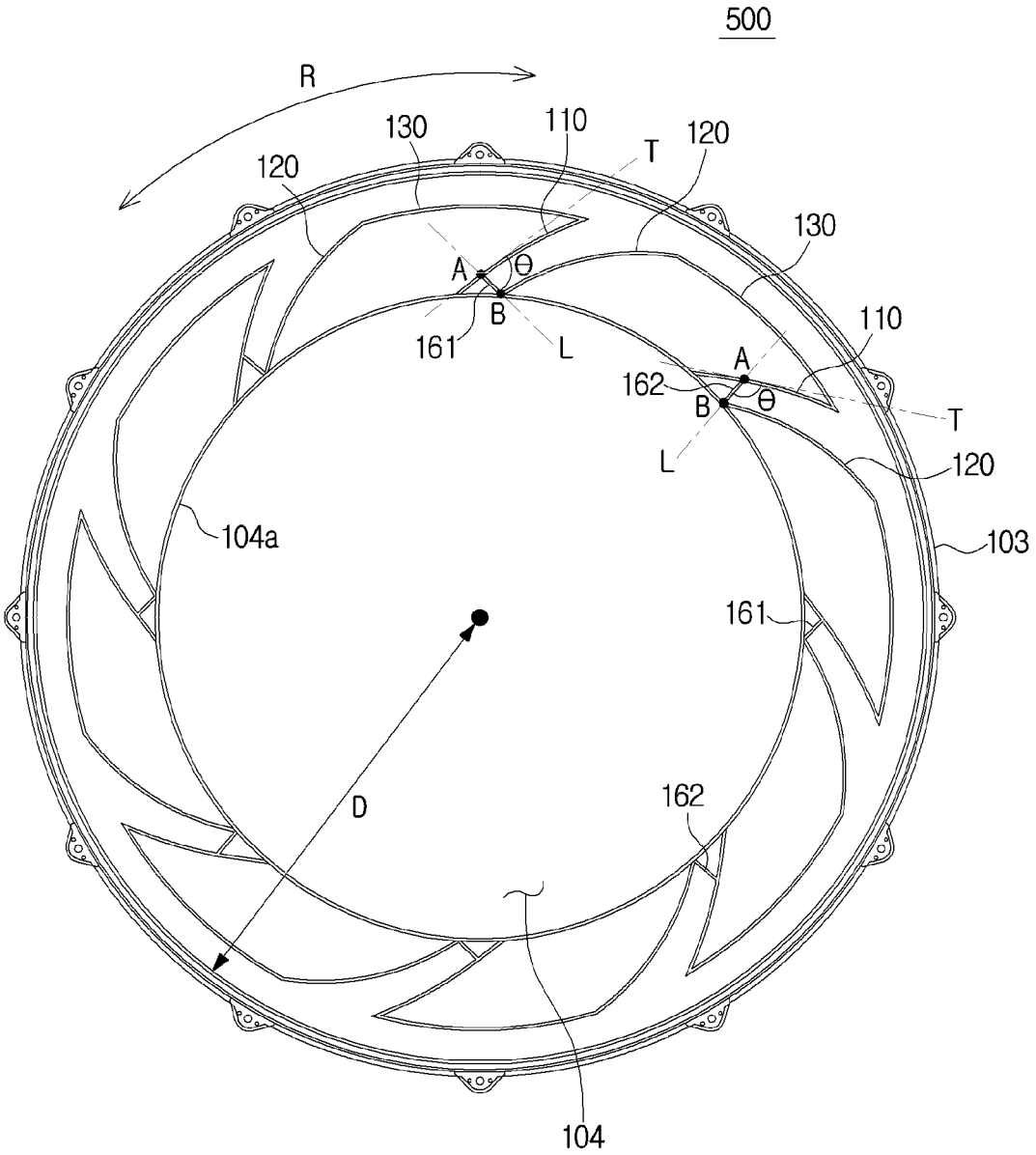
FIG. 10 is a view showing a fifth tub cover of the washing machine according to an embodiment of the present disclosure.

FIG. 10 is a view showing a fifth tub cover of the washing machine according to an embodiment of the present disclosure. Hereinafter, reference numerals not shown will be referred to FIG. 1. Hereinafter, a description overlapping with a description of the first tub cover 100 may be omitted. Hereinafter, a definition of the direction diversion rib angle will be referred to a description of FIG. 9.

As shown in FIG. 10, a first direction diversion rib 161 and a second direction diversion rib 162 having different direction diversion rib angles from each other may be alternately arranged on the bottom surface of a tub cover 500. That is, the first direction diversion rib 161 and the second direction diversion rib 162 having the different direction diversion rib angles from each other may be alternately arranged on the bottom surface of the tub cover 500 along the circumferential direction R of the tub cover 500.

While the present disclosure has been particularly described with reference to exemplary embodiments, it should be understood by those of skilled in the art that various changes in form and details may be made without departing from the spirit and scope of the present disclosure.

The invention claimed is:

1. A washing machine comprising:

a tub;

a rotary tub rotatably provided inside of the tub;

a tub cover coupled to the tub to prevent water from overflowing the tub and having an opening formed in a central portion of the tub cover;

a plurality of guide units formed on a bottom surface of the tub cover, the plurality of guide units including:

a first guide unit; and a second guide unit spaced apart from the first guide unit to form an inner flow path for guiding the water into an inside of the rotating tub, each of the first guide unit and the second guide unit including:

a first guide having an outer end spaced from an edge of the tub cover in an inward direction of the tub cover;

a second guide having an outer end spaced from the edge of the tub cover in the inward direction of the tub cover, and disposed to be spaced apart from the first guide in a circumferential direction of the tub cover; and a third guide connecting the outer end of the first guide and the outer end of the second guide, an inner rib disposed adjacent to the opening of the tub cover to connect the first guide and the second guide; and an outer flow path formed along the circumferential direction of the tub cover to guide the water to the inner flow path, wherein the outer flow path is provided between the third guide and the edge of the tub cover along a radial direction of the tub cover.

2. The washing machine according to claim 1, wherein the third guide has a curvature larger than a curvature of the opening and smaller than a curvature of the edge of the tub cover.

3. The washing machine according to claim 2, wherein the first guide and the second guide extend from the opening toward the edge of the tub cover.

4. The washing machine according to claim 1, further comprising:

a balancer coupled to the rotary tub to compensate dynamic imbalance during a rotation of the rotary tub, and wherein the tub cover comprises:

a first portion positioned in outer side of the tub cover and facing the balancer; and a second portion positioned in inner side of the tub cover and in which the plurality of guide units are formed.

5. The washing machine according to claim 1, wherein the plurality of guide units are spaced apart from each other in the circumferential direction of the tub cover, and the inner rib is formed between the plurality of guide units adjacent to each other such that the water rising along one wall of the tub by a rotation of the rotary tub hits the inner rib and is sprayed into the rotary tub.

6. The washing machine according to claim 5, wherein one end of the inner rib meets with a first guide of one of the plurality of guide units facing each other, and the other end of the inner rib meets with a second guide of the other one of the plurality of guide units facing each other.

7. The washing machine according to claim 6, wherein one of both ends of the inner rib is positioned in outer side of the tub cover than the other one of the both ends of the inner rib.

8. The washing machine according to claim 6, wherein when an angle (θ) formed by a tangent line (T) at one of a first intersection point (A), at which one end of the inner rib and a first guide of one of the plurality of guide units meet, and a second intersection point (B), at which the other end of the inner rib and a second guide of the other one of the plurality of guide units meet, and a straight line (L) connecting the first intersection point (A) and the second intersection point (B) is an inner rib angle, at least one of the inner rib has a different inner rib angle.

9. The washing machine according to claim 8, wherein a first inner rib and a second inner rib having a different inner rib angle are alternately arranged.

10. The washing machine according to claim 1, wherein at least one cushion rib is formed on the bottom surface of the tub cover to be positioned in an outer side of the tub cover than the third guide.

11. The washing machine according to claim 10, wherein the at least one cushion rib has a closed loop shape formed along the circumferential direction of the tub cover.

* * * * *